United States Patent [19]

Rembold et al.

[11] Patent Number: 4,529,366

[45] Date of Patent: Jul. 16, 1985

[54] VANE TYPE COMPRESSOR WITH ELASTIC SEALINGS

[75] Inventors: Helmut Rembold, Stuttgart; Manfred Ruoff, Möglingen, both of Fed. Rep. of Germany

[73] Assignee: Robert Bosch GmbH, Stuttgart, Fed. Rep. of Germany

[21] Appl. No.: 576,526

[22] Filed: Feb. 2, 1984

[30] Foreign Application Priority Data

May 7, 1983 [DE] Fed. Rep. of Germany ..... 3316752

[51] Int. Cl.[3] ..... F04C 27/00; F16J 15/38

[52] U.S. Cl. ..... 418/136; 277/81 P; 277/226; 418/137; 418/241

[58] Field of Search ..... 418/136, 137, 241; 277/34, 34.3, 34.6, 81 P, 226

[56] References Cited

U.S. PATENT DOCUMENTS 2,781,852 2/1957 Rumble ..... 277/226

FOREIGN PATENT DOCUMENTS 278548 4/1934 Italy ..... 418/137
107695 11/1924 Switzerland ..... 418/136
324414 1/1930 United Kingdom ..... 418/136
960696 6/1964 United Kingdom ..... 277/226

*Primary Examiner*—John J. Vrablik
*Assistant Examiner*—T. Olds
*Attorney, Agent, or Firm*—Michael J. Striker

[57] ABSTRACT

In a vane type compressor including a plurality of radial vanes extending from a compressor shaft through the slots in a rotary piston elastic flexible tubes are inserted in the slots and interconnected between the respective vanes and the rotary piston, which serve as sealing members on the vanes. Each flexible tube has an elongated bead engaged in a groove formed either in the vane or in the rotary piston.

9 Claims, 3 Drawing Figures

VANE TYPE COMPRESSOR WITH ELASTIC SEALINGS

BACKGROUND OF THE INVENTION

The present invention pertains to a vane type compressor in general, and more particularly to sealing means provided between the vanes or blades of the compressor and the rotary piston through the slots of which the end portions of the vanes pass.

One of the vane type compressors of the type under discussion has been disclosed in German Patent No. 719,388. In the vane type compressor of the known patent sealing elements are arranged in through passages provided in the rotary piston of the compressor. These sealing elements are connected to the rotary piston by flexible, elastic connecting members. However, the sealing elements in all known instances rub against the outer surfaces of the vanes. Therefore neither the problem of proper sealing of the vanes nor the problem of wear which results therefrom can be optimally solved in operation of vane type compressors with the above discussed sealing means.

SUMMARY OF THE INVENTION

It is an object of the present invention to provide an improved vane type compressor.

It is a further object of the invention to provide an improved sealing means for the vanes extending through the passages provided in the rotary piston of the compressor.

These and other objects of the invention are attained by a vane type compressor, comprising a rotary piston, a shaft eccentrically arranged in said piston, said piston having a plurality of radial slots; a plurality of movable vanes radially extended from said shaft and passing through said slots; and a plurality of sealing means inserted in said slots for sealing said vanes in said rotary piston, said sealing means including elastic flexible tubes interconnected between respective vanes and the rotary piston.

The advantage of the compressor provided with the sealing means according to the invention is that neither the problem of sliding friction or rubbing nor the problem of sufficient sealing of the vanes passing through the slots in the rotary piston occur due to the provision of flexible tubes as sealing means. Owing to the utilization of elastic flexible tubes between the vanes and the rotary piston a rolling movement of the flexible tubes, which causes an inner friction within the tubes is produced.

A further advantage of the present invention resides in that a tangential stroke and a clamping of each vane take place, whereby an acceleration of the vanes is produced and a pressure gradient is at the same time reduced, which leads to reduction of noise.

The flexible tubes may be arranged in each of said slots in pairs so that two opposing flexible tubes engage with two opposing sides of each vane.

Each of the flexible tubes may be provided with at least one longitudinal bead, the rotary piston being formed with a plurality of grooves, said bead being engaged in a respective one of said grooves.

The compressor may further include clamping rails for securing the flexible tubes to the respecting vanes.

It is particularly advantageous that the flexible tubes may be made of rubber-elastic material and have inserts or fillers of elastic textile material.

DETAILED DESCRIPTION OF THE PREFERRED EMBODIMENTS

Figures 1, 2, 3:
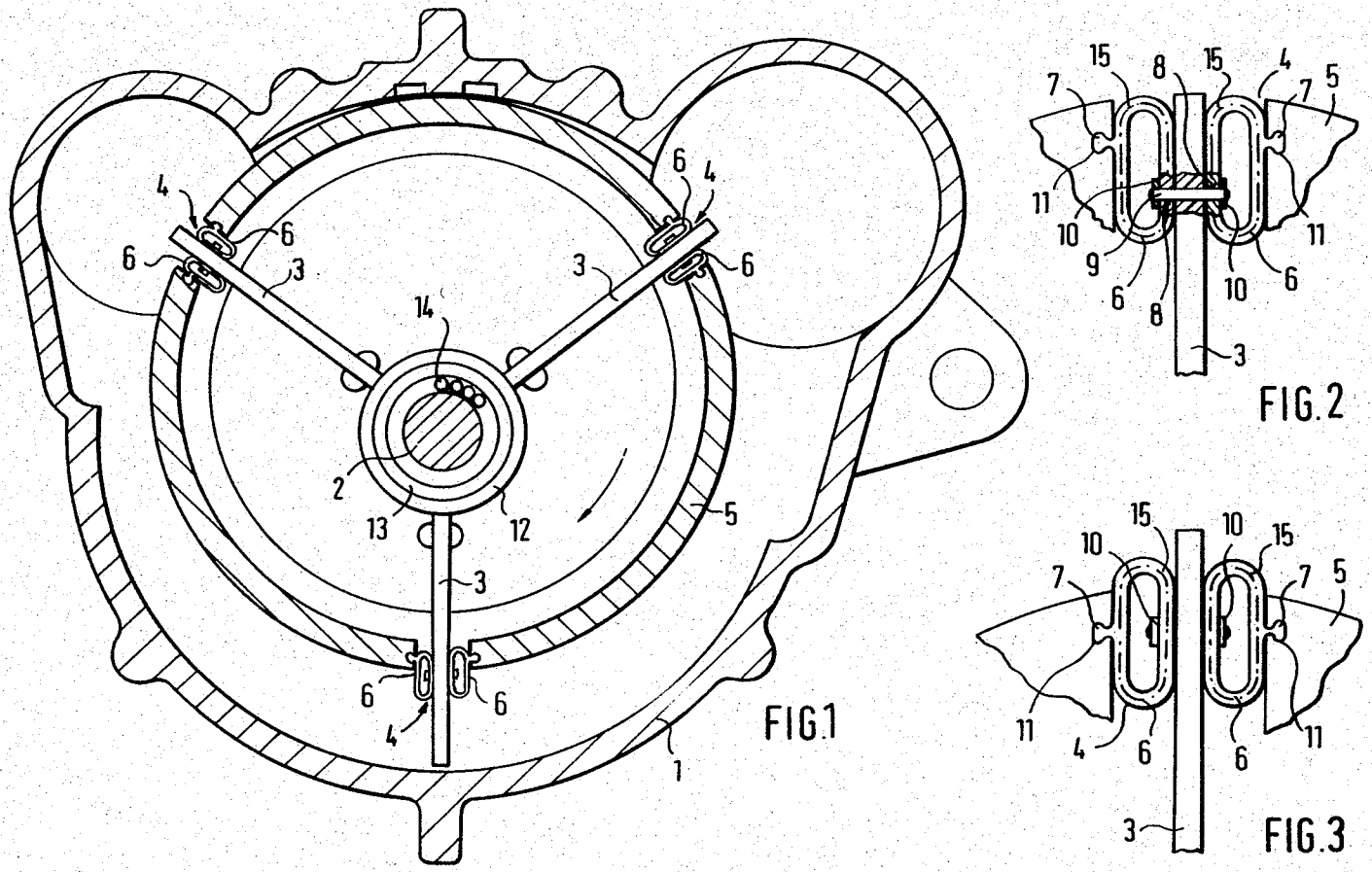
FIG. 1 is a sectional view through a vane type compressor provided with elastic sealing means according to the invention.
FIG. 2 is an enlarged view of the sealing unit according to the invention, disposed between the rotary piston and the compressor vane with the vane fully inserted in the sealing unit.
FIG. 3 is an enlarged view of the sealing unit of FIG. 2 but with the vane maximally displaced in the outward direction.

Referring to the drawings in detail, a compressor shaft 2 which carries thereon a number of impeller vanes 3 is excentrically disposed in the known fashion in a rotary piston 5 positioned within a compressor housing 1. Rotary piston 5 has slots 4 which form through passages for vanes 3, the latter being sealed in slots 4 by means of flexible tubes 6. These flexible tubes are arranged in pairs in contact with the opposite lateral faces of each vane. Each flexible tube 6 has a longitudinal projection or bead 7 and a through opening 8 formed in the side of the flexible tube 6, which is in contact with the respective lateral face of the vane 3, through openings 8 receiving therein bolts 9. Bolts 9 are here a connection means for connecting two clamping rails 10, arranged on the internal faces of the opposing flexible tubes, to each other. Two opposite flexible tubes 6 are thus pressed against two opposite lateral sides of each vane by the clamping rails 10 secured to each other by bolts 9. Longitudinal beads 7 of flexible tubes 6 are received in respective grooves 11 formed in the rotary piston 5.

Base rings 12 to which impeller vanes 3 are connected in the known manner surround bearing bushings 13 which hold bearing needles 14 between shaft 2 and the inner sides of bushings 13.

The manner of fastening flexible tubes 6 has the advantage that they can be connected to the vanes before the assembly of the piston, and the longitudinal beads 7 of the tubes 6 must be inserted during assembling into respective grooves 11 of the rotary piston. It is understandable that the fastening which would have only a bead-nut-connection can be also selected.

In operation of the compressor flexible tubes 6 roll in and out together with the respective vane in slot 4 of the rotary piston 5 in the manner illustrated in FIGS. 2 and 3 whereby no rubbing contact between the sealing means and vanes 3 or rotary piston 5 occurs.

Wear resistance of flexible tubes 6, which are formed of rubber-elastic material, is further improved by fillers or inserts 15 of textile material.

Grooves 11 for receiving beads 7 can be also formed in vanes 3, in the latter case beads 7 will be formed on the sides of the tubes, which face the vane. It is understood that longitudinal bead 7 extends along the length of the elongated flexible tube which bears against the side of the respective vane.

Clamping rails 10 with bolts 10 can connect tubes 6 to the rotary piston 5, in that case respective through openings will be formed in the outer walls of flexible tubes 6.

When the vane 3 is in the retracted position as shown in FIG. 2 the flexible tubes 6 stand slightly behind the periphery of piston 5 and the outer edge of vane 3 as well.

The reciprocating movement of the vanes into and out from the slots at a limited distance is compensated for by a rolling movement of the elastic flexible tubes 6. Thus no friction occurs between the vane and the sealing means.

It will be understood that each of the elements described above, or two or more together, may also find a useful application in other types of vane type compressors differing from the types described above.

While the invention has been illustrated and described as embodied in a vane type compressor, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A vane type compressor, comprising a rotary piston, a shaft eccentrically arranged in said piston, said piston having a plurality of radial slots; a plurality of movable vanes radially extended from said shaft and passing through said slots; and a plurality of sealing means inserted in said slots for sealing said vanes in said rotary piston, said sealing means including elastic flexible tubes, each tube being rigidly connected to a respective vane and also to said piston so that each tube, upon the movement of a respective vane, can roll in a respective slot in a radial direction of said piston.

2. The compressor as defined in claim 1, wherein said flexible tubes are arranged in each of said slots in pairs so that two opposing flexible tubes engage with two opposing sides of each vane.

3. The compressor as defined in claim 2, wherein each of said flexible tubes is provided with at least one longitudinal bead, said piston being formed with a plurality of grooves, said bead being engaged in a respective one of said grooves.

4. The compressor as defined in claim 2, wherein each of said flexible tubes is provided with at least one longitudinal bead, each of said vanes being formed with at least one groove, said bead being engaged in said groove.

5. The compressor as defined in claim 3, further including clamping rails for securing said flexible tubes to the respective vanes.

6. The compressor as defined in claim 4, further including clamping rails for securing said flexible tubes to the rotary piston.

7. The compressor as defined in claim 1, wherein said flexible tubes are made of rubber-elastic material.

8. The compressor as defined in claim 7, wherein each of said flexible tubes has a flexible insert of textile material.

9. The compressor as defined in claim 2, wherein said flexible tubes are arranged in pairs and interconnected between the rotary piston and the respective vanes so that the flexible tubes together with a respective vane can roll in said slots and extend a limited distance from a respective slot over a periphery of the rotary piston and retract back into said slot and when the respective vane is in the most retracted position in one of said slots the flexible tubes remain slightly behind an outer edge of said vane and the periphery of the rotary piston.

* * * * *